US006291944B1

(12) United States Patent
Hesterman et al.

(10) Patent No.: US 6,291,944 B1
(45) Date of Patent: Sep. 18, 2001

(54) SYSTEM AND METHOD FOR LIMITING THROUGH-LAMP GROUND FAULT CURRENTS IN NON-ISOLATED ELECTRONIC BALLASTS

(75) Inventors: Bryce L. Hesterman; Ali Fawaz, both of Madison, AL (US)

(73) Assignee: Universal Lighting Technologies, Inc., Nashville, TN (US)

( * ) Notice: Subject to any disclaimer, the term of this patent is extended or adjusted under 35 U.S.C. 154(b) by 0 days.

(21) Appl. No.: 09/566,252

(22) Filed: May 5, 2000

(51) Int. Cl.[7] ..... H05B 37/02
(52) U.S. Cl. ..... 315/224; 361/42; 361/88
(58) Field of Search ..... 315/224, 174, 315/276, 283, 289, 291, 302, 307; 361/42, 44, 88, 56, 65

(56) References Cited

U.S. PATENT DOCUMENTS

| | | | | |
|---|---|---|---|---|
| Re. 30,304 | * | 6/1980 | Eckart | 361/44 |
| 3,697,810 | * | 10/1972 | Wilson et al. | 317/18 D |
| 3,733,517 | * | 5/1973 | Wilson | 317/18 D |
| 3,754,221 | * | 8/1973 | Stelter | 317/18 D |
| 3,848,159 | * | 11/1974 | Nye, Jr. et al. | 317/18 D |
| 3,975,663 | * | 8/1976 | Moorey | 317/18 R |
| 4,233,639 | * | 11/1980 | Klein et al. | 361/44 |
| 4,893,059 | | 1/1990 | Nilssen | 315/127 |
| 4,939,427 | | 7/1990 | Nilssen | 315/209 R |
| 4,943,886 | | 7/1990 | Quazi | 361/42 |
| 5,363,018 | | 11/1994 | Shackle | 315/127 |
| 5,436,529 | | 7/1995 | Bobel | 315/127 |
| 5,978,190 | * | 12/1999 | Mignault | 361/42 |
| 6,002,260 | * | 12/1999 | Lau et al. | 361/65 |
| 6,040,778 | * | 3/2000 | Hopkins et al. | 361/42 |
| 6,051,940 | | 4/2000 | Arun | 315/307 |
| 6,111,732 | * | 8/2000 | Beland | 361/42 |

* cited by examiner

*Primary Examiner*—Don Wong
*Assistant Examiner*—Thuy Vinh Tran
(74) *Attorney, Agent, or Firm*—Waddey & Patterson; Larry W. Brantley

(57) ABSTRACT

An electronic ballast having a through-lamp ground fault sensor that may also function as an end-of-lamp-life sensor is disclosed. The electronic ballast has an inverter that receives power from a dc power supply, and delivers a high-frequency output voltage to a resonant tank circuit through a dc blocking capacitor. The ground fault sensor includes a filter circuit connected to a voltage sensor circuit. An input terminal of the filter circuit is connected to the resonant tank so as to be in communication with a voltage signal that exists between a ballast output terminal and a dc power supply output terminal. The filter provides a filtered voltage signal by attenuating high frequency ac voltage components of the voltage signal, and passing low frequency ac voltage components, such as a 60 Hz signal, and possibly also passing a dc voltage component. A through-lamp ground fault will generate a voltage signal at the power line frequency. A lamp that has reached the end of its useful life will generate a low frequency ac voltage component that is caused by flickering, as well as a dc voltage component caused by rectification. The voltage sensor provides a control signal in response to the filtered voltage signal that may be used by an inverter control circuit to control the output of the inverter. In response to the control signal, the inverter control circuit either shuts down the inverter or increases the frequency of the inverter in order to reduce the output current of the inverter.

12 Claims, 3 Drawing Sheets

SYSTEM AND METHOD FOR LIMITING THROUGH-LAMP GROUND FAULT CURRENTS IN NON-ISOLATED ELECTRONIC BALLASTS

BACKGROUND OF THE INVENTION

The present invention relates generally to through-lamp ground fault current limiting circuits for electronic ballasts, and also to end-of-lamp-life sensing circuits for electronic ballasts.

More particularly, this invention pertains to a through-lamp ground fault current limiting circuit for a non-isolated electronic ballast operable to limit a through-lamp ground fault current caused when one end of a lamp is connected to the electronic ballast and the other end of the lamp is connected to a grounded person by sensing a low frequency ac voltage or a dc voltage generated by the ground fault.

Section 22 of Underwriters Laboratories Standard UL 935 requires that non-isolated ballasts include some sort of through-lamp ground fault current limiting circuit in order to reduce the risk of electric shock for users of such ballasts. Ground faults occur when a grounded person comes into contact with the pins at one end of a linear fluorescent lamp when the other end of the lamp is inserted in a lamp socket that is wired to an energized ballast. When a ground fault occurs, current flows from the ballast, through the fluorescent lamp and the grounded person, to ground. If the ballast does not include some type of current limiting circuit, the ballast may supply enough current to deliver a harmful shock to the grounded person.

As a result of this requirement, through-lamp ground fault current limiting circuits for electronic ballasts are well known in the art. For example, U.S. Pat. Nos. 6,051,940, 5,436,529, 4,893,059, 4,943,886, 5,363,018, and 4,939,427 all teach circuits that may be used to limit through-lamp currents caused by ground faults.

U.S. Pat. No. 6,051,940 teaches a circuit that may be used to limit through-lamp currents caused by ground faults in an isolated electronic ballast having a output transformer. The circuit operates by sensing the increase in the output voltage of the ballast whenever one or more lamps are disconnected from the ballast. When the output voltage of the ballast exceeds a predetermined limit, the circuit generates a signal that is used to reduce the output voltage of the ballast. As a result, the amount of current flowing through the lamp in response to a ground fault is limited. This circuit is designed to be used with an isolated electronic ballast having an output transformer and, accordingly, may not be used with a non-isolated electronic ballast that does not include an output transformer. In addition, this circuit does not actually sense when a ground fault occurs, but rather, senses when a lamp is disconnected from the ballast.

U.S. Pat. No. 5,436, 529 teaches a method of limiting through-lamp currents caused by ground faults in an electronic ballast by using a circuit to sense the conductive path provided by lamp filaments of a lamp connected to the ballast. If a lamp is disconnected from an operating ballast of this type, the series resonant tank circuit becomes unloaded. As a result, the output voltage of the ballast rises to a high value and a sensing circuit, designed to sense this high voltage, causes the ballast to shut down. Depending upon which of the circuits taught by the patent is used, the ballast will not restart until the filament sensing circuit senses that some or all of the lamp filaments have been re-connected to the ballast.

The circuit shown in FIG. 3 of the '529 patent senses all of the lamp filaments, but it should not be used with certain kinds of electronic ballasts and lamp connections. For example, American National Standard ANSI C82.11-1993, paragraph 7.7.2 requires that when electronic ballasts operate lamps connected in series, and the filaments are heated by a common winding, the filaments must be connected in parallel. In addition, since one pair of wires supplies both filaments in ballasts that comply with this standard, electrical continuity cannot be used to determine the presence of the filaments. Thus, the circuit shown in FIG. 3 of the '529 patent cannot be used for ballasts with series-connected lamps built according to the ANSI C82.11-1993 standard because two of the filaments are wired in series instead of being wired in parallel.

Furthermore, when filaments are connected in parallel, one may not be able to simply measure the resistance between the pair of wires connected to the filaments to determine whether both filaments are present. Lamp filaments for T8 linear lamps are not standardized, and they vary from manufacturer to manufacturer, so one may not be sure whether one or two lamp filaments are connected in parallel to a pair of ballast output terminals by simply measuring the resistance between the pair of terminals. In other words, it is possible for one to measure the same resistance between the pair of terminals when only one filament is connected and when two filaments are connected in parallel.

U.S. Pat. No. 4,893,059 teaches a method of limiting through-lamp ground fault currents by using current sensing transformers. Current sensing transformers, however, are too expensive for certain applications.

Two other patents, U.S. Pat. Nos. 4,943,886, and 5,363, 018, teach a method of limiting through-lamp ground fault currents in an electronic ballast by using a circuit to sense a high-frequency voltage that is developed between the ballast's inverter power supply terminals and earth ground. The circuit must be connected to earth ground in order to operate properly. If the system is not connected to earth ground, the circuit will not function properly.

While most electronic ballast include earth grounds, occasionally, a person installing the electronic ballast may forget to connect the ballast to earth ground. In other situations, the installer may connect the ballast to earth ground in such a manner that the ballast appears to be connected to earth ground but it is not. This may occur when the installer fails to tighten the connection to earth ground properly. Thus, there is a need for a ground fault detection circuit that will operate properly without a connection to earth ground.

Finally, U.S. Pat. No. 4,939,427, teaches a method of using a circuit to sense the high-frequency voltage developed during ground faults using an additional winding on a common-mode inductor that is part of an electromagnetic interference (EMI) filter. This solution, however, degrades the performance of the EMI filter because the additional winding introduces noise into the EMI filter. This occurs because the additional winding must be connected to circuits that generate a substantial amount of RF noise. Thus, there is a need for a through-lamp ground fault current limiting circuit that does not degrade the performance of the EMI filter.

What is needed, then, is a through-lamp ground fault current limiting circuit operable to sense ground faults without degrading the performance of an EMI filter, operable to function properly without a connection to earth ground, and capable of operation with lamps having parallel-connected filaments.

SUMMARY OF THE INVENTION

Accordingly, an object of the present invention is to provide a through-lamp ground fault current limiting circuit operable to sense ground faults in non-isolated electronic ballasts.

Another object is to provide a through-lamp ground fault current limiting circuit for a non-isolated electronic ballast operable to sense ground faults when the ballast is not connected to earth ground.

A further object of the present invention is to provide a method of sensing a ground fault in a non-isolated electronic ballast.

Another object of the present invention is to provide a through-lamp ground fault current limiting circuit that generates a control signal that may be used to control the current output of a non-isolated electronic ballast.

A still further object is to provide a through-lamp ground fault current limiting circuit that generates a control signal in response to sensing a low frequency ac or dc voltage component caused by a ground fault.

Yet another object of the present invention is to provide an end-of-life sensor to that generates a control signal in response to sensing a low frequency ac or dc voltage component caused by flickering that occurs in a lamp that has reached the end of its useful life.

These and other objects of the present invention are provided by a through-lamp ground fault current limiting circuit (or simply a ground fault sensor) for a non-isolated electronic ballast having an inverter that receives power from a dc power supply, and delivers a high-frequency output voltage to a resonant tank circuit through a dc blocking capacitor. The ground fault sensor includes a filter circuit connected to a voltage sensor circuit. The voltage sensor circuit generates a control signal that may be used by an inverter control circuit to control the output of the inverter. An input terminal of the filter circuit is connected to the resonant tank so as to be in communication with a voltage signal that exists between a ballast output terminal and a dc power supply output terminal. The filter provides a filtered voltage signal by attenuating high frequency ac voltage components of the voltage signal, and passing low frequency ac voltage components, such as a 60 Hz signal, and possibly also passing a dc voltage component. A through-lamp ground fault will generate a voltage signal at the power line frequency. A lamp that has reached the end of its useful life will generate a low frequency ac voltage component that is caused by flickering, as well as a dc voltage component caused by rectification. The filter circuit separates the low frequency ac voltage components and the dc voltage component generated by either a ground fault or end-of-life lamp from the high frequency ac voltage components generated by the inverter. The voltage sensor provides a control signal in response to the filtered voltage signal that may be used by the inverter control circuit to control the output of the inverter. In a first embodiment, the inverter control circuit shuts down the inverter based on the control signal, while in an alternative embodiment, the inverter control circuit increases the frequency of the inverter to reduce the current output of the inverter.

In the first embodiment, the ground fault sensor includes a low pass filter for attenuating the high frequency ac voltage components and passing the low frequency ac voltage components of the sensed voltage signal, a charge pump for blocking a dc voltage component and rectifying the passed low frequency ac voltage components, an integrating circuit for converting the rectified low frequency ac voltage component into a control signal, a blanking circuit for inhibiting the control signal until the power supply has stabilized, and a voltage follower or buffer that passes the control signal to an inverter control circuit to control the output of the inverter. In alternative embodiments, the charge pump voltage sensor may be replaced with conventional voltage sensors operable to convert the filtered voltage signal into a control signal suitable for the control inverter control circuit being used. Additionally, the low pass filter may be replaced with a band-pass filter if one does not desire to sense the dc component of the filtered voltage signal.

A lamp that has reached the end of its useful life will generate a low frequency ac voltage component that is caused by flickering, as well as a dc voltage component caused by rectification. The low frequency ac voltage component caused by flickering will typically have a frequency less than about 200 Hz. The voltage sensor may be designed to sense low frequency ac voltage components caused by flickering in addition to ac signals at the power line frequency caused by a through-lamp ground fault. The dc voltage component produced by and end-of-life lamp may be either positive or negative. A voltage sensor that responds to both positive and negative dc components of the filtered voltage signal may be designed to sense dc signals caused by an end-of-life lamp in addition to a dc component of the filtered voltage signal caused by a through-lamp ground fault.

DESCRIPTION OF THE PREFERRED EMBODIMENTS

Figure 1:
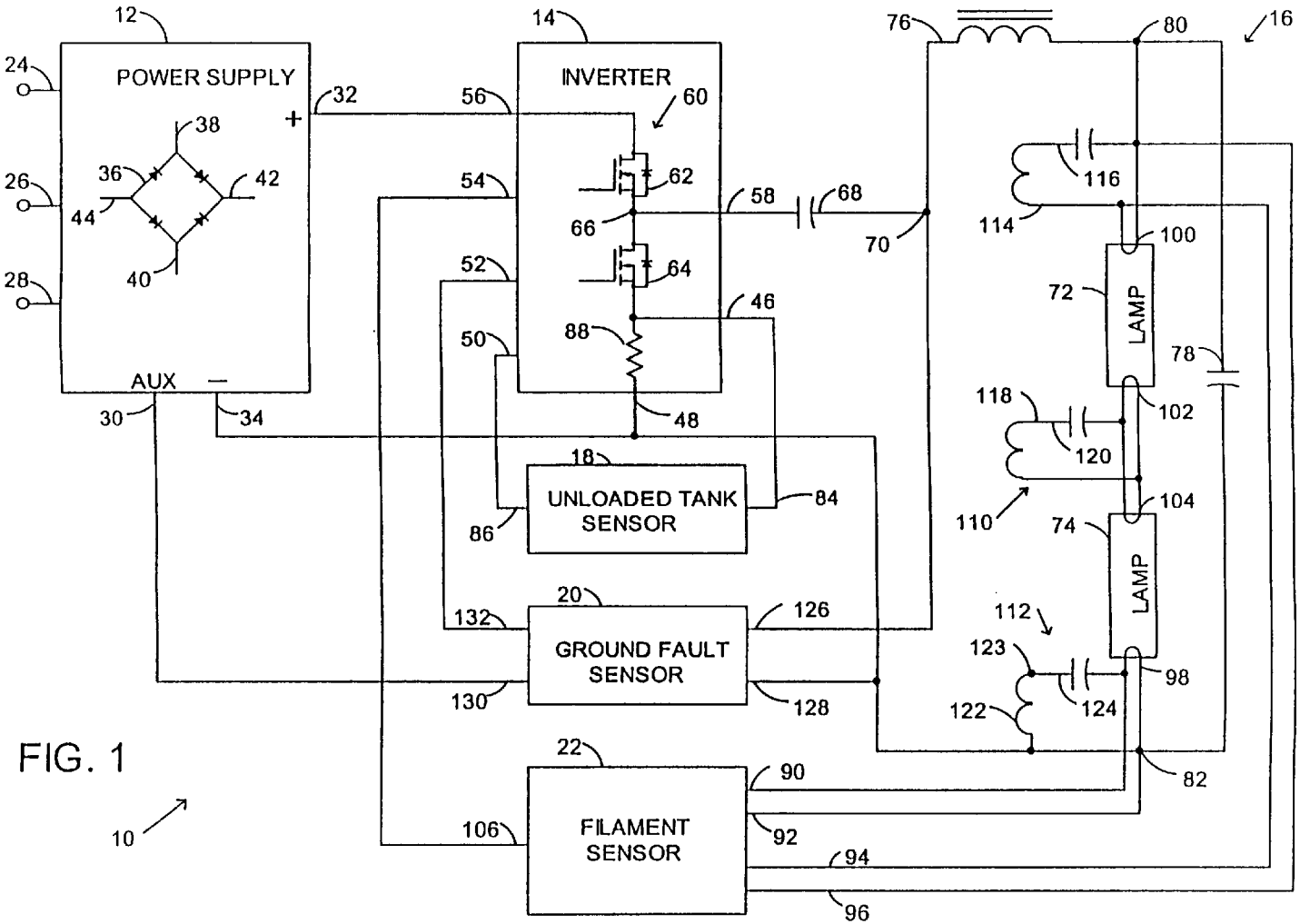
FIG. 1 is a block diagram of one embodiment of a non-isolated electronic ballast including a through-lamp ground fault sensor of the present invention.

Referring to FIG. 1, one embodiment of an electronic ballast 10 equipped with a through-lamp ground fault current limiting circuit (also referred to as a ground fault sensor) of the present invention is shown. The electronic ballast includes a power supply 12, an inverter 14, a resonant tank circuit 16, an unloaded tank sensor 18, a ground fault sensor 20, and a filament sensor 22.

Power supply 12 is designed to generate a dc voltage signal in response to an ac voltage signal received from an ac power source. As such, power supply 12 includes two ac power source inputs, 24 and 26, an earth ground input 28, an auxiliary power supply output 30, and two dc power supply output terminals, 32 and 34. AC power source inputs, 24 and 26, are adapted to be connected to the ac power source (not shown) and the earth ground input 28 is adapted to be connected to an earth ground (not shown).

Power supply 12 also includes a bridge rectifier circuit 36 connected to the two ac power source inputs, 24 and 26, and dc power supply outputs, 32 and 34. Bridge rectifier circuit 36 includes bridge inputs, 38 and 40, and bridge outputs, 42 and 44. In one embodiment, bridge input 38 is directly connected to ac power source input 24, bridge input 40 is directly connected to ac power source input 26, bridge output 42 is directly connected to dc power supply output 32, and bridge output 44 is directly connected to dc power supply output 34. In alternative embodiments, the ac power source may be connected to the bridge rectifier circuit 36 through an EMI filter (not shown) or a passive power factor correction circuit (not shown) and the bridge rectifier circuit 36 may be connected to the dc power supply output terminals, 32 and 34, through an active power factor correction circuit (not shown).

Inverter 14 is designed to receive the dc voltage signal generated by power supply 12, and to generate a high-frequency voltage signal (typically, equal or greater than approximately 20,000 Hz) in response to the dc voltage signal. Inverter 14 includes inputs 48, 50, 52, 54, and 56, as well as inverter output 58, and a sensing terminal 46. Input 56 is connected to the dc power supply output 32 and a half-bridge circuit 60 included in the inverter 14. Inputs 50, 52, and 54 are connected to an inverter control circuit (not shown) that controls the high-frequency voltage output of inverter 14. Inverter control circuits are known in the art and the present invention contemplates using one of these known inverter control circuits to control the inverter 14. In one embodiment, the inverter control circuit is designed to shut down the inverter, increase the frequency of the high-frequency voltage output, or restart the lamp lighting process in response to control signals received on inputs 50, 52, and 54.

Half-bridge circuit 60 includes a first transistor 62 connected in series with a second transistor 64 at a junction 66, as well as a transistor control circuit (not shown) for controlling transistors 62 and 64. Transistor control circuits are well known in the art and the present invention contemplates using one of these known transistor control circuits.

Junction 66 is connected to inverter output 58, which is, in turn, connected to capacitor 68. Capacitor 68 is included in the circuit in order to block any dc voltage that is present with the high-frequency voltage signal generated by the inverter 14. Capacitor 68 is connected to resonant tank circuit 16 at a junction 70.

Resonant tank circuit 16 is designed to generate a high frequency, high amplitude, sinusoidal voltage signal for striking fluorescent lamps, 72 and 74. Once the lamps, 72 and 74, are lit, tank circuit 16 provides a high-frequency, essentially sinusoidal current to lamps 72 and 74. To accomplish this function, resonant tank circuit 16 includes inductor 76 and capacitor 78. Inductor 76 is connected to capacitor 78 at a junction 80 and capacitor 78 is connected to power supply output 34 at junction 82. Alternatively, capacitor 78 and filament heating circuit 112 (discussed below) may be connected to power supply terminal 32 instead of terminal 34. In this case, ground fault sensor 128 should be connected to terminal 32.

Unloaded tank sensor 18 is designed to sense when a lamp is disconnected from the ballast 10, and includes sensor input 84 and sensor output 86. When either lamp 72 or lamp 74 is removed from the ballast 10, the voltage at junction 80 increases and causes the current flowing out of inverter output 58 to increase as well. This increase in current may be sensed by connecting a resistor 88 between the half-bridge circuit 60 of inverter 14 and power supply output 34, and measuring the voltage across resistor 88. As the current flowing through resistor 88 increases, the voltage across resistor 88 increases. Unloaded tank sensor 18 measures this voltage using a sensor input 84 that is connected to resistor 88 using sensing terminal 46, and generates an unloaded tank control signal that is delivered to the inverter control circuit (not shown) using sensor output 86 and inverter input 50. The inverter control circuit controls the inverter output based on the unloaded tank control signal. In one embodiment, the inverter control circuit shuts down the inverter, while in another embodiment, the inverter control circuit may simply increase the frequency of the inverter output voltage.

Alternatively, the unloaded tank sensor 18 may directly sense the voltage increase at junction 80. In this embodiment, input 84 of the unloaded tank sensor 18 is connected to junction 80 (also referred to as a ballast output terminal). The voltage at junction 123 also increases when either lamp 72 or 74 is removed from ballast 10. As a result, the unloaded tank sensor 18 may also directly sense the voltage increase at junction 123 in order to determine that a lamp has been removed from ballast 10.

Filament sensor 22 is designed to generate a missing filament signal at filament sensor output 106 when either one of the filaments, 98 or 100, is removed from ballast 10. Filament sensor 22 includes inputs 90, 92, 94, and 96. Inputs 90 and 92 are connected across filament 98 of lamp 74 and inputs 94 and 96 are connected across filament 100 of lamp 72. Lamp 72 also includes filament 102 that is connected in parallel with filament 104 of lamp 74. When either lamp 72 or 74 is removed from the ballast 10, filament sensor 22 generates a missing filament signal that is passed to the inverter control circuit using filament sensor output 106 and inverter input 54. When either lamp 72 or 74 is reconnected to ballast 10, the filament sensor 22 no longer generates the missing filament signal and, as a result, the inverter control circuit attempts to restart the lamps. In alternative embodiments, the missing filament signal may be used to shut down or increase the frequency of the inverter 14 as well.

Ballast 10 also includes filament heating circuits, 108, 110, and 112, for heating filaments 98, 100, 102, and 104. Heating circuit 108 includes an inductor 114 and capacitor 116, heating circuit 110 includes inductor 118 and capacitor 120, and heating circuit 112 includes inductor 122 and capacitor 124. Inductors 114, 118, and 122 are magnetically coupled to inductor 76.

If lamp 72 is removed from ballast 10 and the inverter 14 has been shut down, and then filament 100 of lamp 72 is reconnected to ballast 10, the ballast 10 will attempt to re-strike both lamps. If a grounded person is touching the lamp terminals that are connected to filament 102, then lamp 72 may strike and, as a result, a high frequency ground fault current will pass through the person to ground. According to Section 22 of Underwriters Laboratories Standard UL 935, the magnitude and duration of such a high frequency ground fault current must be limited in order to avoid giving the person a harmful shock. The ground fault sensor 20 of the present invention provides a novel system and method for limiting this high frequency ground fault current.

When a ground fault occurs, a low frequency ac voltage at the power line frequency will be developed between junction 80 and terminals 32 and 34. In addition to the low frequency ac voltage component, a dc voltage is generated between junction 80 and power supply output terminals 32 and 34 when a ground fault occurs. These voltages at junction 80 are superimposed on the high-frequency voltage produced by inverter 14 and resonant tank 16. The low-frequency ac voltage component the dc voltage component are produced because lamp 72 provides a conductive path from junction 80 to earth ground, and terminals 32 and 34 both have a voltage with respect to ground due to the operation of bridge rectifier 36 in power supply 12 that has a low frequency ac voltage component at the power line frequency in combination with a dc voltage component. Because inductor 76 has a low impedance at the power line frequency, the low frequency ac voltage component and the dc voltage component appear at junction 70 as well as at junction 80. If the impedance of capacitors 68 and 78 are high at the power line frequency, then the low frequency ac voltage component at junction 70 will be large enough that it may be sensed by ground fault sensor 20 by connecting ground fault sensor input 126 to junction 70 and ground fault sensor input 128 to power supply output 34. Alternatively, ground fault sensor 126 may be connected to junction 80 and ground fault sensor input 128 may be connected to power supply output 32.

When a lamp, such as lamp 72 or lamp 74, approaches the end of its useful life, the lamp begins to flicker. This flickering causes a low frequency ac voltage component to appear at junctions 80 and 70. Ground fault sensor 20 may also be used to sense this low frequency ac voltage component and to generate a control signal that may be used to limit the output current of the inverter.

By measuring the low frequency ac voltage component or the dc voltage component between junction 70 and power supply output 34 (or alternatively power supply output 32), a ground fault may be sensed and inverter 14 may be controlled so that the current flowing through the lamp and the person is limited to a predetermined safe value. Section 22 of Underwriters Laboratories Standard UL 935 lists various safe values of current for several different inverter frequencies.

Figure 2:
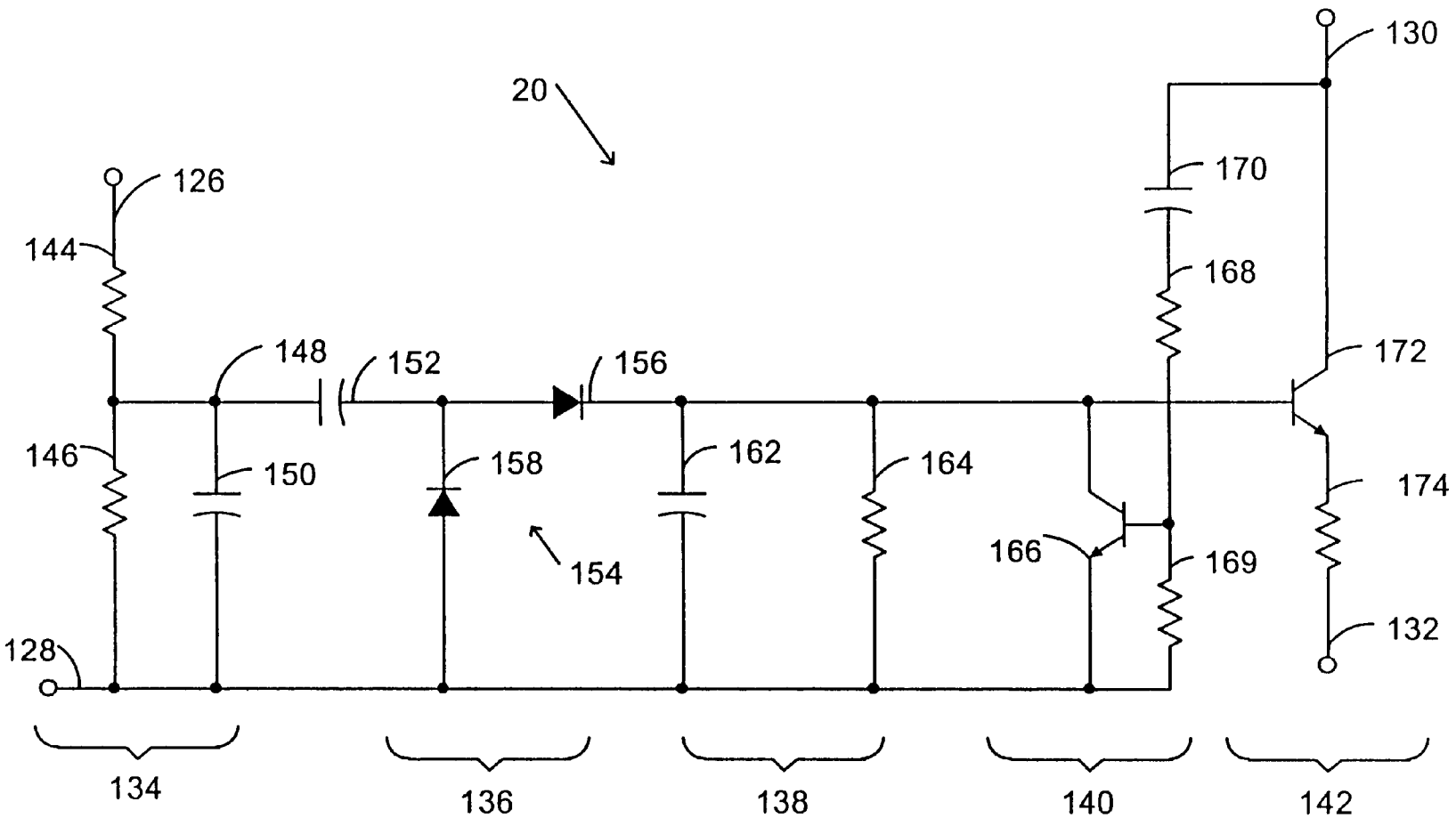
FIG. 2 is a circuit diagram of one embodiment of a through-lamp ground fault current limiting circuit of the present invention.

To accomplish this function, ground fault sensor 20 includes ground fault sensor inputs, 126, 128, and 130 and a ground fault sensor output 132 (see FIGS. 1 and 2). Ground fault sensor input 126 is connected to junction 70 and ground fault sensor input 128 is connected to power supply output 34. Ground fault sensor input 130 is connected to auxiliary power supply output 30 and ground fault sensor output 132 is connected to the inverter control circuit (not shown) using inverter input 52.

Ground fault sensor 20 further includes a low pass filter 134, a charge pump 136, an integrating circuit 138, a blanking circuit 140, and a voltage follower (or buffer) 142. Low pass filter 134 attenuates high-frequency ac voltage components of a voltage signal present between junction 70 and power supply output terminal 34 and passes a filtered voltage signal containing low frequency ac voltage components and a dc voltage component of the voltage signal to junction 148. Low pass filter 134 includes a resistor 144 having one end connected to one end of another resistor 146 at a junction 148. The other end of resistor 144 is connected to junction 70 using ground fault sensor input 126 and the other end of resistor 146 is connected to a junction 129, which is in turn connected to the power supply output 34 using ground fault sensor input 128. Resistor 146 is connected in parallel with capacitor 150 to complete the low pass filter 134. Ground fault sensor input 126 is also referred to as the input terminal of low pass filter 134.

Charge pump 136 is designed to block dc voltages and to rectify the low frequency ac component of the filtered voltage signal and, accordingly, includes a dc blocking capacitor 152 and a rectifier 154. One end of the dc blocking capacitor 152 is connected to junction 148 and is designed to block any dc voltage signals combined with the low frequency ac voltage component. Rectifier 154 includes a diode 158 having a cathode connected to one end of dc blocking capacitor 152 and an anode connected to terminal 128. Rectifier 154 also includes a diode 156 having an anode connected to the cathode of diode 158 and a cathode connected to an integrator capacitor 162.

Integrating circuit 138 is designed to provide a delay in the ground fault sensor 20 in order to prevent false alarms caused by short transient voltage pulses that may occur between junction 70 and power supply output 34. As such, the integrating circuit 138 includes capacitor 162 connected between the cathode of diode 156 and terminal 128. A resistor 164 is connected in parallel with capacitor 162 to complete the integrating circuit 138. Charge pump 136 charges capacitor 162. When a ground fault occurs, the voltage across capacitor 162 increases to a predetermined level that is indicative of the ground fault. In alternative embodiments, integrating circuit 138 may be omitted if short transient voltage pulses are not expected to occur.

Blanking circuit 140 is designed to disable ground fault sensor 20 until the voltage between power supply output terminals 32 and 34 has stabilized after power supply 12 is initially turned on. In an alternative embodiment, inverter 14 may be designed with a built in delay that prevents inverter 14 from generating an output voltage until after the voltage between the power supply output terminals, 32 and 34, has stabilized. In this alternative embodiment, delay circuit 140 may possibly be omitted. Blanking circuit 140 includes a transistor 166 having a collector and emitter connected across resistor 164 using junctions 155 and 129 and a base connected to the auxiliary power supply output 30 through a resistor 168 in series with a capacitor 170. A resistor 169 is connected between the base and emitter of transistor 166.

Auxiliary power supply 30 is a low voltage dc power supply, typically 15 volts, that may receive power from the inverter 14 or from an active power factor correction circuit (not shown) in power supply 12. The voltage at terminal 30 depends on the voltage between the dc power supply terminals 32 and 34. Consequently, step increases in auxiliary power supply voltage may occur when the power is first applied or when an active power factor correction circuit begins to operate. When a step increase occurs, the blanking circuit turns on for a predetermined amount of time and inhibits the control signal. The predetermined amount of time should be long enough to allow output voltage of the power supply to stabilize.

Voltage follower 142 is designed to generate a current that is supplied to the inverter control circuit using ground fault sensor output 132 and inverter input 52. As such, the voltage follower 142 includes a transistor 172 having a collector connected to the auxiliary power supply 30 using ground fault sensor input 130, a base connected to the collector of transistor 166, and a resistor 174 having one end connected to an emitter of transistor 172 and one end connected to ground fault sensor output 132. In alternative embodiments using an inverter control circuit that requires less current, voltage follower 142 may be omitted.

In one exemplary embodiment of the ground fault sensor 20 of FIG. 2, the component values for the ground fault sensor 20 are as follows: resistor 144=560,000 ohms, resistor 146=100,000 ohms, resistor 164=330,000 ohms, resistor 168=150,000 ohms, resistor 169=20,000 ohms, resistor 174=10,000 ohms, capacitor 150=100 nanofarads, capacitor 152=100 nanofarads, capacitor 162=220 nanofarads, capacitor 170=1 microfarad, diodes 156 and 158 are part number 1N4148, and transistors 166 and 172 are part number 2N3904.

Figure 3:
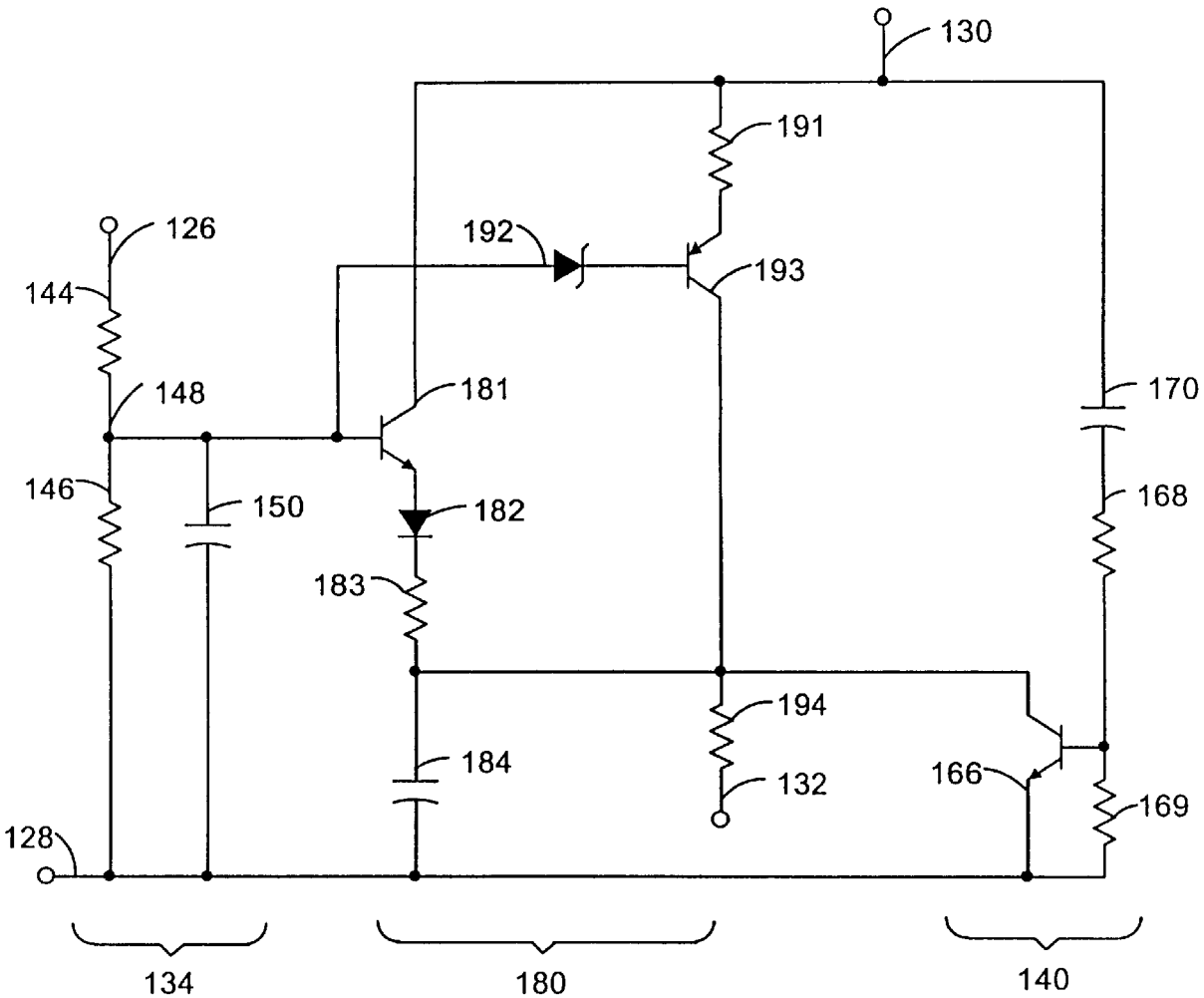
FIG. 3 is a circuit diagram of an alternative embodiment of a through-lamp ground fault current limiting circuit of the present invention.

An alternative embodiment of the ground fault sensor 20 designed to sense the dc voltage component of the filtered voltage signal rather than the low frequency ac voltage component is shown in FIG. 3. This embodiment includes low pass filter 134, blanking circuit 140, and replaces charge pump 136 and integrating circuit 138 with a full wave rectifier 180 that is connected to an integrating capacitor 184. Full-wave rectifier 180 includes transistors 181 and 191, a zener diode 192 and resistors 183 and 191.

When the filtered voltage signal is positive, full wave rectifier 180 charges integrating capacitor 184 through transistor 181, diode 182, and resistor 183. When the filtered voltage signal is negative, full wave rectifier 180 charges integrating capacitor 184 through transistor 193. This is accomplished by connected zener diode 192 between junction 148 and base of transistor 193. The breakdown voltage of zener diode 192 should be approximately equal to the value of the auxiliary power supply voltage at terminal 130. The value of resistor 191 should be approximately equal to the value of resistor 183. A resistor 194 is used to couple the integrated output of the full wave rectifier to terminal 132 to provide a control signal that may be used to control the output of inverter 14.

When a ground fault occurs, then the dc voltage component of the filtered voltage signal will be positive when terminal 128 is connected to terminal 34 and will be negative when terminal 128 is connected to terminal 132. By using a full wave rectifier, this embodiment of ground fault sensor 20 generates a positive control signal whether the dc voltage component of the filtered signal is positive or negative. A half-wave rectifier of appropriate polarity may be used to sense ground faults if end-of-lamp-life sensing is not required. When using a half-wave rectifier, positive signals should be rectified if terminal 128 is connected to terminal 134, and negative signals should be rectified if terminal 128 is connected to terminal 132.

When a lamp reaches the end of its useful life, the lamp will conduct current in one direction more easily than the other, and as a result, a dc voltage component will be developed at junction 80. This voltage may be either positive or negative. The alternative embodiment of FIG. 3 may be used to sense the dc voltage component generated by a lamp approaching the end of its useful life by using the full wave rectifier.

In one exemplary embodiment of the ground fault sensor 20 of FIG. 3, the component values for the ground fault sensor 20 are as follows: resistor 144=560,000 ohms, resistor 146=100,000 ohms, resistor 168=150,000 ohms, resistor 169=20,000 ohms, resistor 183=10,000 ohms, resistor 191=10,000 ohms, resistor 194=10,000 ohms, capacitor 150=100 nanofarads, capacitor 170=1 microfarad, capacitor 184=1 microfarad, diode 182 is part number 1N4148, diode 192 is part number 1N5245B, transistors 166 and 181 are part number 2N3904, and transistor 193 is part number 2N3906.

The embodiments of ground fault sensor 20 shown in FIG. 2 and three are implemented with analog circuitry, but equivalent functionality may be obtained with digital circuitry such as a microcontroller and analog-to-digital converters.

Thus, although there have been described particular embodiments of the present invention of a new and useful System and Method For Limiting Ground Fault Through-Lamp Currents in an Electronic Ballast, it is not intended that such references be construed as limitations upon the scope of this invention except as set forth in the following claims.

What is claimed is:

1. A ground fault sensor for a non-isolated electronic ballast having a dc power supply coupled to an inverter and a resonant tank circuit coupled to the inverter through a dc blocking capacitor, comprising:

a filter circuit having an input terminal in communication with a ballast output terminal that is connected to the resonant tank circuit, the filter circuit operable to attenuate high frequency ac voltage components of a voltage signal at the input terminal to generate a filtered voltage signal; and a voltage sensor in communication with the filter circuit and operable to provide a control signal in response to the filtered voltage signal;

wherein the control signal is indicative of a ground fault.

2. The ground fault sensor of claim 1, wherein the voltage sensor comprises a charge pump in communication with an integrating circuit.

3. The ground fault sensor of claim 1, further comprising a blanking circuit in communication with the voltage sensor and operable to inhibit the control signal until the power supply has stabilized.

4. The ground fault sensor of claim 1, wherein the voltage sensor comprises a full wave rectifier in communication with an integrating circuit.

5. A method of sensing a ground fault in a non-isolated electronic ballast having a power supply, an inverter, and a resonant tank circuit, comprising the steps of:

attenuating high frequency ac voltage components of a voltage signal at an input terminal of a filter circuit in communication with a ballast output terminal to obtain a filtered voltage signal; and generating a control signal in response to the filtered voltage signal using a voltage sensor;

wherein the control signal is indicative of a ground fault.

6. The method of claim 5, wherein generating a control signal in response to the filtered voltage signal, comprises the steps of:

rectifying the filtered voltage signal using a charge pump; and integrating the rectified filtered voltage signal to obtain the control signal.

7. The method of claim 5, wherein generating a control signal in response to the filtered voltage signal, comprises the steps of:

rectifying the filtered voltage signal using a full wave rectifier; and integrating the rectified filtered voltage signal to obtain the control signal.

8. The method of claim 6, further comprising the step of:

inhibiting the control signal until the power supply has stabilized.

9. An end-of-lamp-life sensor for an electronic ballast having a dc power supply coupled to an inverter and a resonant tank circuit coupled to the inverter through a dc blocking capacitor, comprising:

a filter circuit having an input terminal in communication with a ballast output terminal that is connected to the resonant tank circuit, the filter circuit operable to attenuate high frequency ac voltage components of a voltage signal at the input terminal to generate a filtered voltage signal; and a voltage sensor in communication with the filter circuit and operable to provide a control signal in response to the filtered voltage signal;

wherein the control signal is indicative that a lamp connected to the ballast has reached the end of its useful life.

10. The ground fault sensor of claim 9, wherein the voltage sensor comprises a charge pump in communication with an integrating circuit.

11. The end-of-lamp-life sensor of claim 9, further comprising a blanking circuit in communication with the voltage sensor and operable to inhibit the control signal until the power supply has stabilized.

12. The end-of-lamp-life sensor of claim 9, wherein the voltage sensor comprises a full wave rectifier in communication with an integrating circuit.

* * * * *